US010415217B2

(12) United States Patent
Shay et al.

(10) Patent No.: US 10,415,217 B2
(45) Date of Patent: Sep. 17, 2019

(54) FLEXIBLE TUB SPOUT

(71) Applicant: Kohler Co., Kohler, WI (US)

(72) Inventors: Christopher M. Shay, Sheboygan, WI (US); Shashank Varma, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 68 days.

(21) Appl. No.: 15/178,051

(22) Filed: Jun. 9, 2016

(65) Prior Publication Data

US 2017/0356169 A1 Dec. 14, 2017

(51) Int. Cl.
*E03C 1/04* (2006.01)
*A47K 3/02* (2006.01)

(52) U.S. Cl.
CPC ..... *E03C 1/0404* (2013.01); *A47K 3/02* (2013.01); *E03C 1/0403* (2013.01)

(58) Field of Classification Search
CPC ..... E03C 1/0404; E03C 1/0403; E03C 1/042; A47K 3/005; B05B 1/18; B05B 1/185; B05B 1/22
See application file for complete search history.

(56) References Cited

U.S. PATENT DOCUMENTS 1,925,359 A * 9/1933 Alonso ..... E03C 1/306 285/8
2,171,023 A * 8/1939 Buxton ..... E03C 1/08 138/118
3,520,325 A 7/1970 Stuart
3,739,806 A 6/1973 Bucknell et al.
3,765,455 A * 10/1973 Countryman ..... E03C 1/0404 137/607
3,871,406 A * 3/1975 Anderson ..... E03C 1/0404 137/801
4,084,620 A * 4/1978 Bucknell ..... F16K 19/00 137/360
6,119,286 A 9/2000 Briscoe
6,775,866 B1 * 8/2004 Martir ..... E03C 1/0404 239/602
6,840,267 B1 * 1/2005 Jennings ..... E03C 1/042 137/360
D567,384 S 4/2008 Sakulsacha et al.
7,588,197 B2 * 9/2009 Finell ..... A47K 3/005 222/110
8,424,559 B2 * 4/2013 Huang ..... F16K 1/12 137/359
8,439,074 B2 5/2013 Farag
2008/0083844 A1 * 4/2008 Leber ..... B05B 15/066 239/600
2008/0196159 A1 * 8/2008 Lee ..... E03C 1/0404 4/678
2011/0186163 A1 8/2011 Farag

* cited by examiner

*Primary Examiner* — Janie M Loeppke
(74) *Attorney, Agent, or Firm* — Foley & Lardner LLP

(57) ABSTRACT

A spout for a tub. The spout for the tub includes a spout body having opposite first and second sides. The spout also includes an inlet portion extending from the first side, where the inlet portion includes an inlet bore and an outlet portion extending from the second side, where the outlet portion includes an outlet bore that is in fluid communication with the inlet bore. The spout further includes an engine configured with waterway geometry, wherein the engine is installed in the spout body through the inlet portion. In addition, the spout body is made of a flexible material.

20 Claims, 2 Drawing Sheets

FLEXIBLE TUB SPOUT

BACKGROUND

The present disclosure relates generally to the field of plumbing fixtures (e.g., showers, bathtubs, etc.). More specifically, the present disclosure relates to spout shells made of a flexible material.

SUMMARY OF THE INVENTION

One embodiment relates to a spout for a tub. The spout for the tub includes a spout body having opposite first and second sides. The spout also includes an inlet portion extending from the first side, where the inlet portion includes an inlet bore and an outlet portion extending from the second side, where the outlet portion includes an outlet bore that is in fluid communication with the inlet bore. The spout further includes an engine configured with waterway geometry, wherein the engine is installed in the spout body through the inlet portion. In addition, the spout body is made of a flexible material.

Another embodiment relates to a spout for a tub. The spout for the tub includes a spout body having opposite first and second sides. The spout also includes an inlet portion extending from the first side, where the inlet portion includes an inlet bore and an outlet portion extending from the second side, where the outlet portion includes an outlet bore that is in fluid communication with the inlet bore. The spout further includes an engine configured with waterway geometry, wherein the spout is molded around the engine. In addition, the spout body is made of a flexible material.

The foregoing summary is illustrative only and is not intended to be in any way limiting. In addition to the illustrative aspects, embodiments, and features described above, further aspects, embodiments, and features will become apparent by reference to the drawings and the following description.

BRIEF DESCRIPTION OF THE DRAWINGS

Further features, characteristics, and advantages of the present disclosure will become apparent to a person of ordinary skill in the art from the following detailed description of embodiments of the present disclosure, made with reference to the drawings annexed, in which like reference characters refer to like elements.

DETAILED DESCRIPTION

Various aspects of the disclosure will now be described with regard to certain examples and embodiments, which are intended to illustrate but not to limit the disclosure. Nothing in this disclosure is intended to imply that any particular feature or characteristic of the disclosed embodiments is essential. The scope of protection is defined by the claims that follow this description and not by any particular embodiment described herein. Before turning to the figures, which illustrate exemplary embodiments in detail, it should be understood that the application is not limited to the details or methodology set forth in the description or illustrated in the figures. It should also be understood that the terminology is for the purpose of the descriptions only ad should not be regarded as limiting.

Generally speaking, the body of conventional tub spouts are made of rigid materials (e.g., brass, zinc alloy, hard plastics, etc.). These materials can cause bodily harm if a person hit the spout (e.g., from slipping, falling, etc.). This can be especially problematic for children, elderly people, or pets.

Accordingly, referring generally to the figures, discloses herein are flexible spout bodies for attaching to water inlets that minimize the risk of injury if hit by a user.

Figure 1:
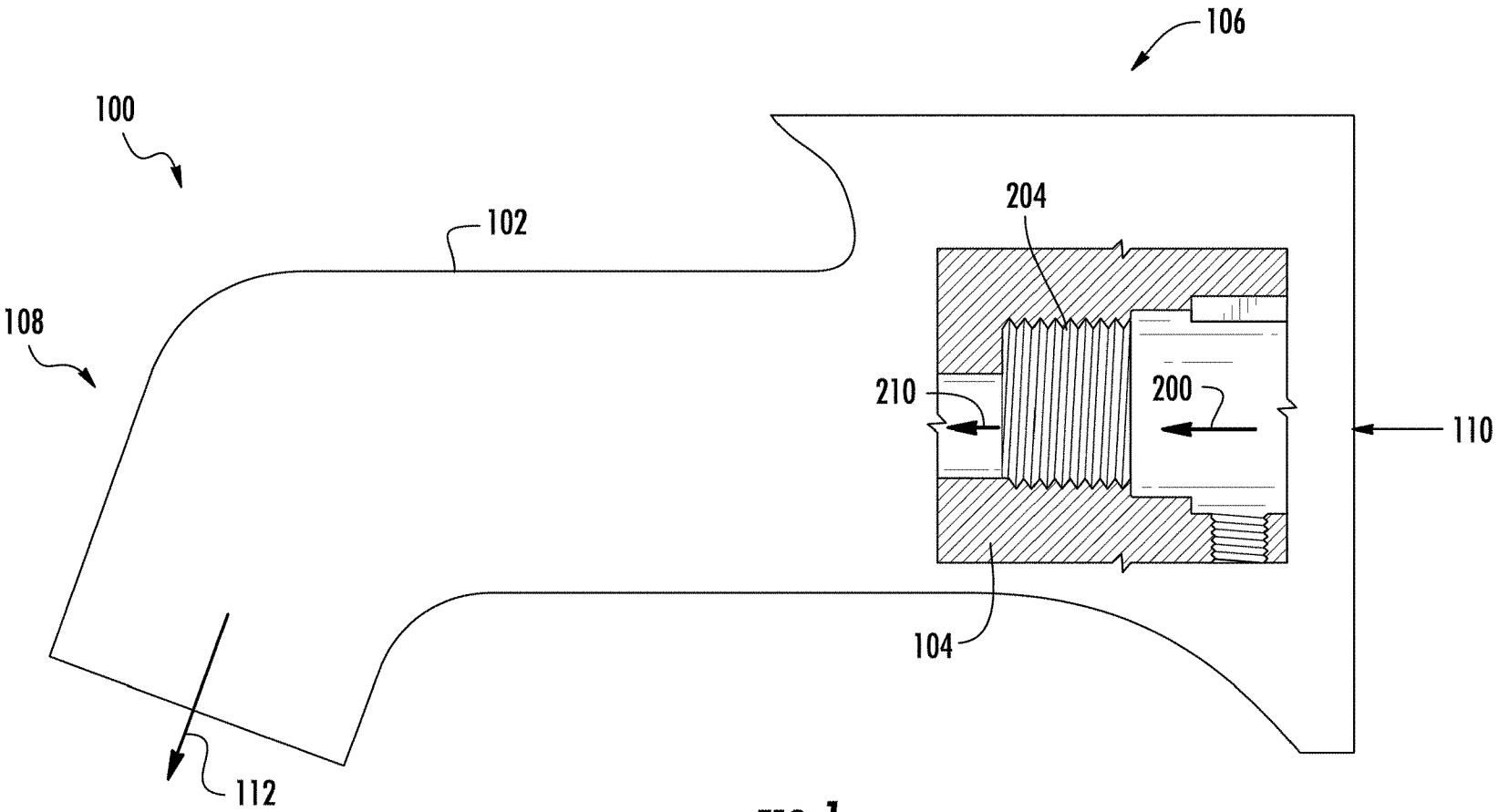
FIG. 1 is a sectional view of a tub spout assembly, according to an exemplary embodiment.
Figure 2:
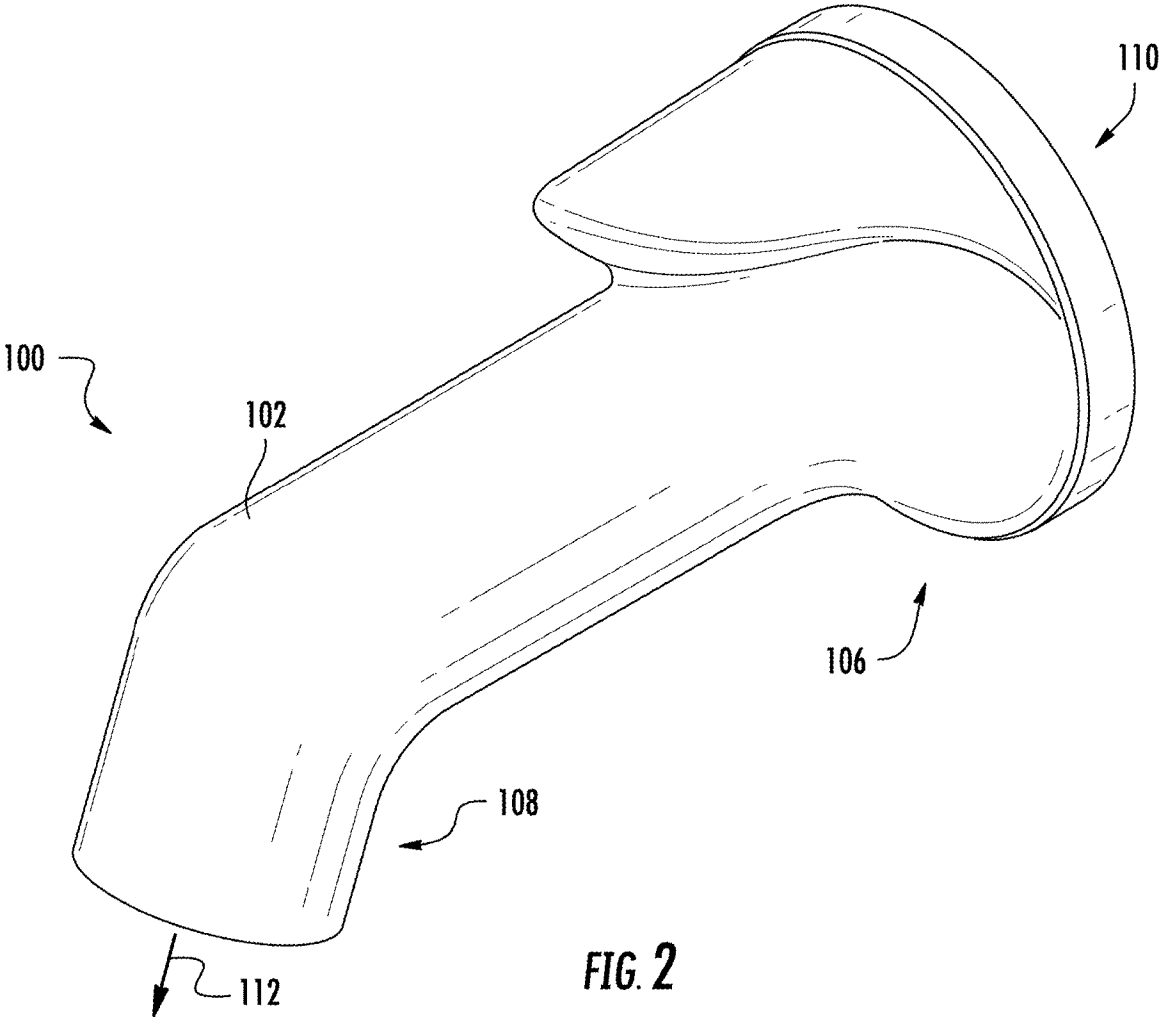
FIG. 2 is a perspective view of the tub spout assembly of FIG. 1, according to an exemplary embodiment.

According to an exemplary embodiment of FIGS. 1 and 2, a tub spout assembly 100 includes a spout body 102 and an engine 104. The spout body 102 is configured to receive the engine 104. The spout body 102 includes a first side 106 and a second side 108. The first side 106 may be configured to lie flush against a wall when the tub spout assembly 100 is installed. In another embodiment, the first side 106 may be configured such that only a portion of the first side 106 lies flush against the wall when the tub spout assembly 100 is installed. The second side 108 may be configured such that it does not share a longitudinal axis with the first side 106. For example, the second side 108 and the first side 106 may be perpendicular to one another. As another example, the second side 108 and the first side 106 may have longitudinal axes that create an angle greater than 90 degrees. In another embodiment, the first side 106 and the second side 108 may be configured such that the first side 106 and the second side 108 share a longitudinal axis. The first side 106 may have a conical shape. In another embodiment, the first side 106 may rectangular. The second side 108 may be annular. In another embodiment, the second side 108 may be rectangular. However, the first side 106 and the second side 108 may take other forms as well. In some embodiments, the first side 106 includes a securing mechanism. The securing mechanism secures the spout body 102 to a wall on which the spout assembly 100 is installed. The securing mechanism may be screws, a mechanism that extends the length of the spout body 102 such that tension is created between the water pipe when connected and the wall, or other means of securing the spout body 102 to the wall.

The spout body 102 may also include an inlet portion 110 extending from the first side 106. The spout shell may also include an outlet portion 112 extending from the second side 108. The inlet portion 110 and the outlet portion 112 are in fluid communication with one another. In some embodiments, the inlet portion 110, the outlet portion 112, or both the inlet portion 110 and the outlet portion 112 are annular. In another embodiment, the inlet portion 110, the outlet portion 112, or both the inlet portion 110 and the outlet portion 112 are rectangular or of a different shape. The inlet portion 110 and the outlet portion 112 may be shaped the same, or may have different shapes. In some embodiments, the inlet portion 110 may have a shape that matches the first side 106. In another embodiment, the inlet portion 110 may have a shape that is different than the first side 106. In some embodiments, the outlet portion 112 may have a shape that matches the second side 108. In another embodiment, the outlet portion 112 may have a shape that is different than the second side 108.

In some embodiments, the tub spout assembly 100 includes a lift rod hole. The lift rod hole may be located on the second side 108. The lift rod hole may extend into the outlet portion 112. The lift rod hole defines an opening configured to secure a shroud. In some embodiments, the shroud is plastic. The shroud may be configured to prevent water from exiting out the lift rod hole. The shroud may also be configured to secure a lift rod. In some embodiments, the tub spout assembly 100 also includes a diverter intended to vary a direction of water flowing into the tub spout assembly 100.

In some embodiments, the spout assembly 100 includes sealing components. The sealing components are intended to provide a seal between the engine 104 and a water pipe. In another embodiment, the sealing components provide a seal between the engine 104 and the spout body 102. In some embodiments, the sealing components are installed in the engine 104 before the engine 104 is installed in the spout body 102. In another embodiment, the sealing components are installed in the spout body 102 before the engine 104 is installed in the spout body 102.

The engine 104 is intended to provide connection between the spout shell 102 and a water pipe. The engine 104 may also be intended to direct the flow of water or provide sealing components between the spout shell 102 and the water pipe. The engine 104 includes an inlet 200. The inlet 200 is configured with waterway connection geometry. The waterway connection geometry may include a slip-fit connection. In another embodiment, the waterway connection geometry may include national pipe threading (NPT) 204, as shown in FIG. 1. The exterior of the engine 104 should be configured to fit snugly inside the inlet portion 106 of the tub spout body 102. The exterior of the engine 104 may include ridges and/or grooves. The ridges and/or grooves may be configured to aid in securing the engine 104 in the spout body 102 by altering the geometry of the exterior of the engine 104. In some embodiments, the ridges and/or grooves are sealing receivers and may be configured to allow sealing components to be installed in the engine 104. The body of engine 104 may be cylindrical. In another embodiment, the body of engine 104 may be tapered from the inlet 200. The engine 104 also includes an outlet 210. The outlet 210 is in fluid communication with the inlet 200. The outlet 210 provides water to the outlet portion 112 of the spout body 102. The outlet 210 may be structured to direct water in a specified direction.

The engine 104 may include a locking mechanism that secures the engine 104 into the spout body 102. The locking mechanism may include one or more locking lips. The locking lips may be structured such that when the engine 104 is being inserted into the spout body 102, the locking lips compress. When the locking lips reach a designated depth, a free end extends past the designated depth and expands, locking the engine 104 into place. In another embodiment, the locking mechanism may be threads. In this embodiment, the spout body 102 would also include threads. In another embodiment, the engine 104 is not a separate component and is integral with the spout body 102. In another embodiment, the engine 104 is may be attached to the spout shell 102 via a slip-on connection. In some embodiments, the engine 104 may be attached to the spout shell 102 via over-molding. The engine 104 may be installed or manufactured in the spout body 102 at a location such that when the pipe is connected to the waterway connection geometry, the first side 106 of the spout body 102 abuts a wall on which the spout assembly 100 is being installed. In addition, the engine 104 may be installed or manufactured in the first portion 106, closest to the wall where the spout assembly 100 is being installed.

The spout body 102 is made of a flexible material. The flexible material may have a natural resistance to bacterial growth and may be easy to clean, which may provide benefits to a user, especially one with children or pets. For example, the spout body 102 may be made of silicone or rubber. Even though the spout body 102 is flexible, it may be configured to secure a metal or plastic engine 104, which attaches to a copper stub-out from a wall, providing water. However, with a flexible spout body 102, a user will minimize injury if the user accidentally hits the spout assembly 100 with a leg, elbow, hear or other body part, making a more kid and pet friendly spout assembly 100. In addition, the flexible spout body 102 allows a user to manipulate the spout body 102, allowing a flow of water to be directed to a certain location (e.g., to clean around a drain). While the spout body 102 is flexible, the spout assembly 100 operates comparably to a standard spout assembly made of metal or plastic.

The flexible material of spout body 102 may allow flexibility profile to be established along the length of the spout body. To achieve the flexibility profile, the thickness of the flexible material may vary along the length of the spout body 102. In another embodiment, the geometry of the flexible material may allow high flexibility in one direction, but limit the flexibility in another direction. In yet another embodiment, the geometry of the flexible material may vary along the length of the spout body 102, creating varying flexibilities along the length of the spout body 102. In some embodiments, the rigidity of the flexible material may vary along the length of the spout body 102 to create the flexibility profile.

The spout body 102 may be molded with internal features. In some embodiments, the internal features may include flow guides. The flow guides are intended to direct the flow of water through the spout body. The flow guides may provide a more stable flow of water out of the outlet portion 112, minimizing the turbulence of the water. The flow guides may also reduce the noise created by water flowing through the spout body 102, or alter the noise created by the water flowing through the spout body. The flow guides may provide some or all of the features described.

According to any embodiment, a spout for a tub is shown to include a spout body, an engine, a diverter, a securing mechanism and sealing components. The spout body is shown to include a first portion, a second portion, an inlet, an outlet, a lift rod hole, a shroud, and is flexible. The engine is shown to include an inlet, waterway connection geometry and an outlet. However, other embodiments may include or omit certain components to suit particular applications.

As utilized herein, the terms "approximately," "about," "around," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the spout assemblie as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Features of any of the embodiments may be employed separately or in combination with any other feature(s) of the same or different embodiments and the disclosure extends to and includes all such arrangements whether or not described herein.

Other substitutions, modifications, changes and omissions may also be made in the design, operating conditions and arrangement of the various exemplary embodiments without departing from the scope of the inventions described herein.

What is claimed is:

1. A spout for a tub, the spout comprising:
an engine configured to be coupled to a water pipe; and
a spout body constructed from a single flexible material and having opposite first and second sides, the spout body comprising:
an inlet portion extending from the first side; and
an outlet portion extending from the second side, wherein the outlet portion is in fluid communication with the inlet portion;
wherein the spout body receives the engine through the inlet portion;
wherein the engine is entirely contained within the spout body;
wherein the engine is coupled to the spout body via a deformation of the engine; and
wherein the spout body is configured to contact fluid within the outlet portion.

2. The spout of claim 1, further comprising a diverter.

3. The spout of claim 1, wherein the flexible material is resistant to bacterial growth.

4. The spout of claim 1, wherein the engine is attached to the spout body via over-molding.

5. The spout of claim 1, wherein the flexible material is silicone.

6. The spout of claim 1, wherein the flexible material is rubber.

7. The spout of claim 1, wherein the spout body can be manipulated to direct a flow of water.

8. The spout of claim 1, wherein the engine is configured with national pipe threading (NPT).

9. The spout of claim 1, wherein the engine is configured with a slip-fit connection.

10. The spout of claim 1, further comprising one or more sealing components.

11. A spout for a tub, the spout comprising:
an engine configured to be coupled to a water pipe; and
a spout body constructed from a single flexible material and being of a single unitary construction and having opposite first and second sides, the spout body comprising:
an inlet portion extending from the first side; and
an outlet portion extending from the second side, wherein the outlet portion is in fluid communication with the inlet portion;
wherein the spout body receives the engine through the inlet portion;
wherein the engine is entirely positioned within the spout body;
wherein the engine is coupled to the spout body via a deformation of the engine; and
wherein the spout body is configured to contact fluid within the outlet portion.

12. The spout of claim 11, further comprising a diverter.

13. The spout of claim 11, wherein the flexible material is resistant to bacterial growth.

14. The spout of claim 11, wherein the engine is contained within the spout body.

15. The spout of claim 11, wherein the flexible material is silicone.

16. The spout of claim 11, wherein the flexible material is rubber.

17. The spout of claim 11, wherein the spout body can be manipulated to direct a flow of water.

18. The spout of claim 11, wherein the engine is configured with national pipe threading (NPT).

19. The spout of claim 11, wherein the engine is configured with a slip-fit connection.

20. The spout of claim 11, further comprising one or more sealing components.

* * * * *